US005936203A

United States Patent [19]

Ryman

[11] Patent Number: 5,936,203

[45] Date of Patent: Aug. 10, 1999

[54] RADIATING COAXIAL CABLE WITH OUTER CONDUCTOR FORMED BY MULTIPLE CONDUCTING STRIPS

[75] Inventor: Henry Ryman, Orland Park, Ill.

[73] Assignee: Andrew Corporation, Orland Park, Ill.

[21] Appl. No.: 08/951,175

[22] Filed: Oct. 15, 1997

[51] Int. Cl.[6] ..... H01B 9/02

[52] U.S. Cl. ..... 174/109; 174/102 SP

[58] Field of Search ..... 174/108, 102 R, 174/102 SP, 109; 333/237, 243

[56] References Cited

U.S. PATENT DOCUMENTS

| | | | |
|---|---|---|---|
| 2,971,193 | 2/1961 | Siukola | 343/770 |
| 3,781,725 | 12/1973 | Yoshida et al. | 333/84 R |
| 3,909,757 | 9/1975 | Miyamoto et al. | 333/97 R |
| 4,300,338 | 11/1981 | Harman et al. | 333/237 X |
| 4,339,733 | 7/1982 | Smith | 333/237 |
| 4,599,121 | 7/1986 | Edwards et al. | 333/237 X |
| 4,660,007 | 4/1987 | Edwards et al. | 333/237 |
| 4,910,998 | 3/1990 | Wilis et al. | 73/40.5 R |
| 5,349,133 | 9/1994 | Rogers | 174/108 X |
| 5,414,437 | 5/1995 | Mahnad | 343/770 |

FOREIGN PATENT DOCUMENTS

| | | |
|---|---|---|
| 0 300 147 A1 | 5/1988 | European Pat. Off. . |
| 60-89136 | 5/1985 | Japan . |

OTHER PUBLICATIONS

A. Levisse, "Radiating Cables—Channel Tunnel Applications" *Electrical Communication—1st Quarter 1994,* pp. 66–73.

D. J. R. Martin, "Radio Communication in Mines" *The Mining Engineer,* Dec. 1977/Jan. 1978 pp. 275–282.

*Primary Examiner*—Dean A. Reichard

*Attorney, Agent, or Firm*—Arnold, White & Durkee

[57] ABSTRACT

A coaxial radiating cable comprised of a plurality of conductive strips wrapped in coaxial relationship to a center conductor and separated by a dielectric core. The plurality of conductive strips define in combination an outer conductor of the radiating cable and have a width and wrap angle selected to form apertures along the cable in a desired pattern, size and/or shape. The cable is designed to be efficiently and inexpensively manufactured and is designed to be coiled and uncoiled without significant distortion.

17 Claims, 5 Drawing Sheets

RADIATING COAXIAL CABLE WITH OUTER CONDUCTOR FORMED BY MULTIPLE CONDUCTING STRIPS

FIELD OF THE INVENTION

The present invention relates generally to the field of radiating coaxial cables and, more particularly, to a radiating coaxial cable with an outer conductor having a plurality of apertures formed by multiple conducting strips.

BACKGROUND OF THE INVENTION

Radiating coaxial cables, sometimes referred to as "leaky" coaxial cables, have proven to be useful for a wide variety of communications applications such as, for example, transmitting and receiving signals within tunnels or buildings. Generally, radiating cables include a center conductor and an outer conductor separated by a layer of dielectric material, in which the outer conductor is provided with a plurality of slots or apertures along the length of the cable. The slots or apertures serve to couple electromagnetic energy radiating within the cable to fields radiating outside of the cable, such that the cable may be used as a distributed antenna for transmitting or receiving electromagnetic energy. The design of a leaky cable is a delicate balance between the transmission characteristics of the cable and the desired radiation characteristics. The leakage rate and radiation pattern along the cable may be controlled by an appropriate selection of slot size or pattern along the length of the cable. Small changes in the slot pattern or in the design of the cable can significantly change the transmission loss and/or the radiating characteristics of the cable.

There are a variety of known techniques for producing radiating cables having a plurality of slots or apertures on the outer conductor. In one form of cable, the slots or apertures on the outer conductor are formed by a process of milling or punching the surface of an initially solid outer conductor. The manufacture of this form of cable is a relatively slow and expensive process and produces a cable with a stiff, relatively inflexible structure. The bending and unbending, coiling and uncoiling of this form of cable under normal use or manufacture typically deforms the outer conductor and produces unsightly wrinkles on the exterior of the outer conductor which are visible even through the protective outer jacket of the cable. The bending and unbending of the cable may also cause the slots or apertures to become pinched or dilated so as to produce undesired leakage and/or radiation effects along the length of the cable.

Another known form of cable utilizes a braided outer conductor, formed by a braiding machine from groups of wires or "bobbins," each typically including 2 to 10 individual wires. Although cables with braided outer conductors may be coiled and reasonably bent without distortion, the manufacturing of braided leaky cables is a relatively slow and expensive process, requiring the step of periodically stopping the braiding machine to remove some of the wire forming the braid in order to form the apertures.

In view of the aforementioned disadvantages associated with known types of radiating cables, there is a need for an alternative type of radiating cable having a plurality of apertures formed on its outer conductor, which may be used as a distributed antenna for transmitting or receiving electromagnetic energy, but which may be quickly and inexpensively manufactured and which may be coiled and reasonably bent without significant distortion. The present invention is directed to addressing these needs.

SUMMARY OF THE INVENTION

In accordance with one aspect of the present invention, there is provided a radiating coaxial cable comprising a center conductor, a dielectric surrounding the center conductor, and an outer conductor formed by first and second conductive strips. The first and second conductive strips are wrapped about the dielectric in coaxial relationship to the center conductor and define a plurality of gaps or apertures between the first and second conductive strips for radiating and receiving electromagnetic energy. The first conductive strip is spirally wound about the dielectric to define a plurality of wraps separated by a first helical gap, and the second conductive strip is spirally wound about the first conductive strip to define a plurality of wraps separated by a second helical gap. The wraps of the first and second conductive strips define in combination the outer conductor of the radiating coaxial cable, and the first and second helical gaps intersect to define the plurality of apertures of the radiating coaxial cable. The width of the first and second conductive strips, the wrap angle of the first and second conductive strips and the width of the helical gaps may be varied as needed or desired to affect the size and/or shape of the apertures and thereby affect the radiation characteristics of the cable.

In accordance with another aspect of the present invention, there is provided a radiating coaxial cable comprising a center conductor, a dielectric surrounding the center conductor, and an outer conductor formed by a plurality of conductive strips. A first number of conductive strips are wrapped about the dielectric at an angle of about zero degrees relative to the center conductor and define one or more longitudinal gaps along the length of the cable, whereas a second number of conductive strips are spirally wrapped about the dielectric at an angle greater than zero degrees relative to the center conductor and define one or more helical gaps along the length of the cable. The intersection of the longitudinal gap(s) and helical gap(s) define a plurality of apertures for radiating and receiving electromagnetic energy. The width of the conductive strips, the wrap angle of the conductive strips and the width of the helical gaps may be varied as needed or desired to affect the size and/or shape of the apertures and thereby affect the radiation characteristics of the cable.

BRIEF DESCRIPTION OF THE DRAWINGS

The foregoing and other advantages of the invention will become apparent upon reading the following detailed description and upon reference to the drawings in which.

Figure 1B:
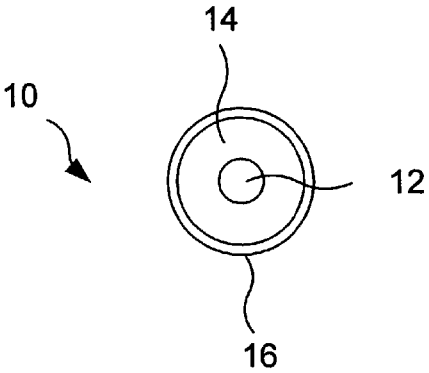
FIG. 1*b* is an end view of the radiating coaxial cable of FIG. 1*a;*

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 1A:
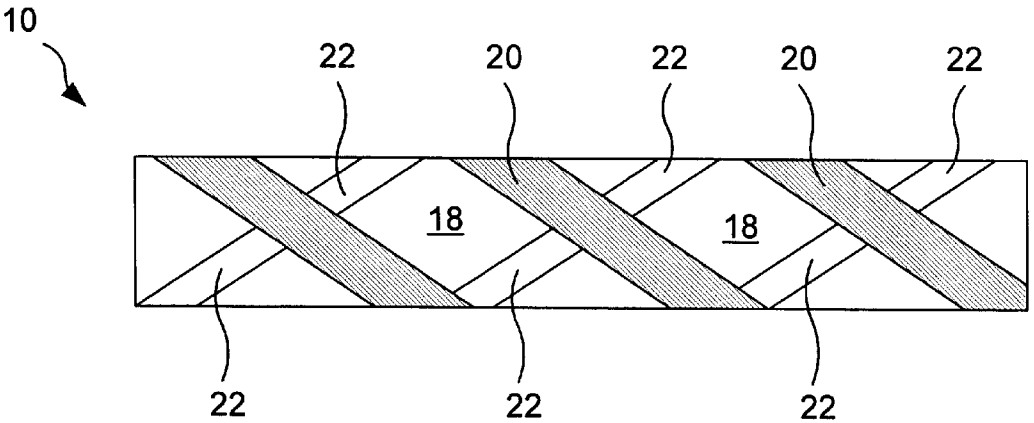
FIG. 1*a* is a side view of a radiating coaxial cable with apertures formed by two conducting strips according to one embodiment of the present invention.
Figure 1C:
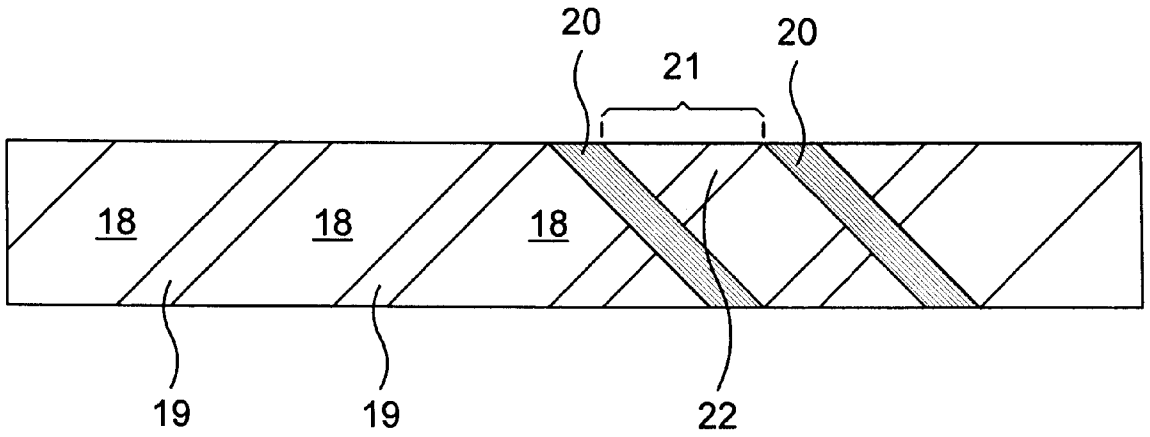
FIG. 1*c* is a side view depicting an intermediate step in constructing the radiating coaxial cable of FIG. 1*a;*

Turning now to the drawings and referring initially to FIGS. 1*a* through 1*c*, there is shown a radiating coaxial cable, generally designated by reference numeral 10, illustrating one embodiment of the present invention. The cable 10 is comprised of a center conductor 12 (FIG. 1*b*) surrounded by a dielectric core 14, and an outer conductor 16 formed by conductive strips 18 and 20 disposed on an outer surface of the dielectric core 14. The center conductor 12 and conductive strips 18,20 may consist of virtually any type of conductive material including, for example, copper or aluminum, whereas the dielectric core 14 may consist of virtually any type of dielectric (non-conductive) material. The conductive strips 18 and 20 are wrapped about the dielectric 14 in coaxial relationship to the center conductor 12 and define a plurality of gaps or apertures 22 between the conductive strips 18 and 20 for radiating and receiving electromagnetic energy in response to excitation of the cable 10. The width and wrap angle of conductive strips 18 and 20 affect the pattern, size and shape of the apertures 22, which in turn affects the radiation characteristics of the cable 10.

In the embodiment shown in FIGS. 1*a* through 1*c*, the conductive strips 18 and 20 are spirally wrapped about the dielectric 14 at generally opposing wrap angles to produce generally rectangular apertures 22 along the length of the cable 10. It will be appreciated, however, that conductive strips 18,20 may be wrapped at virtually any wrap angle sufficient to produce a desired pattern, size and/or shape of apertures 22. The wrap angle of either or both of the conductive strips 18,20 may also be progressively varied along the length of the cable 10 as needed or desired to affect the radiation characteristics of the cable 10. It will further be appreciated that cable 10 may be constructed of more than two conductive strips each wrapped at a selected wrap angle about the dielectric 14.

In one embodiment, conductive strip 18 comprises a 1-inch wide copper strip and conductive strip 20 comprises a ¼-inch wide copper strip, wound around ⅞-inch foam dielectric core 14. Conductive strip 18 is spirally wrapped in a clockwise manner about the dielectric 14 at an angle of about 45 degrees relative to the center conductor 12. Adjacent wraps of conductive strip 18 are separated from each other by a continuous helical gap 19 having a width of about 0.1 inch (FIG. 1*c*). Next, the second conductive strip 20 is spirally wound in a counterclockwise manner about portions of the dielectric 14 and portions of the helical gap 19. Adjacent wraps of conductive strip 20 are separated from each other by a continuous helical gap 21 having a width of about 0.66 inches. Conductive strip 20 physically and electrically contacts portions of the underlying conductive strip 18 such that the first and second conductive strips 18,20 define in combination the outer conductor 16 of the radiating coaxial cable 10. Conversely, the intersection of helical gaps 19,21 define the apertures 22 of the radiating coaxial cable 10. In this embodiment, the apertures 22 are formed in three rows along the length of cable 10, each aperture 22 having a width of about 0.1 inches (corresponding to the width of helical gap 19) and a length of about 0.66 inches (corresponding to the width of helical gap 21). In one embodiment, the cable 10 is then wrapped with a protective outer cover or "jacket" to protect the cable 10 from elements, abrasions and the like.

As stated above, the pattern, size and shape of the apertures 22 may be varied by changing the width and wrap angle of the conductive strips 18,20 and the width of the helical gaps 19,21. The apertures 22 may be graded (i.e., made progressively larger (or smaller) along the length of the cable 10) by progressively increasing (or decreasing) the width of either or both helical gaps 19,21 to compensate for attenuation losses as signals propagate through the cable and allow for an even distribution of energy along the cable.

Figure 1D:
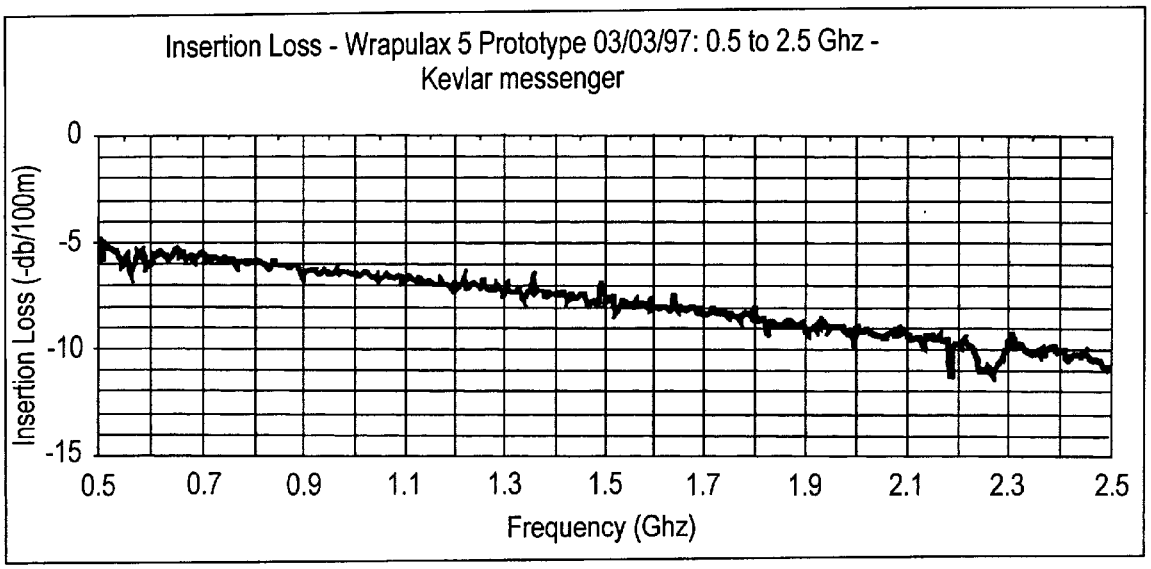
FIGS. 1*d* and 1*e* are graphs of experimentally-derived insertion loss versus frequency for the radiating coaxial cable of FIG. 1*a;*
Figure 1E:
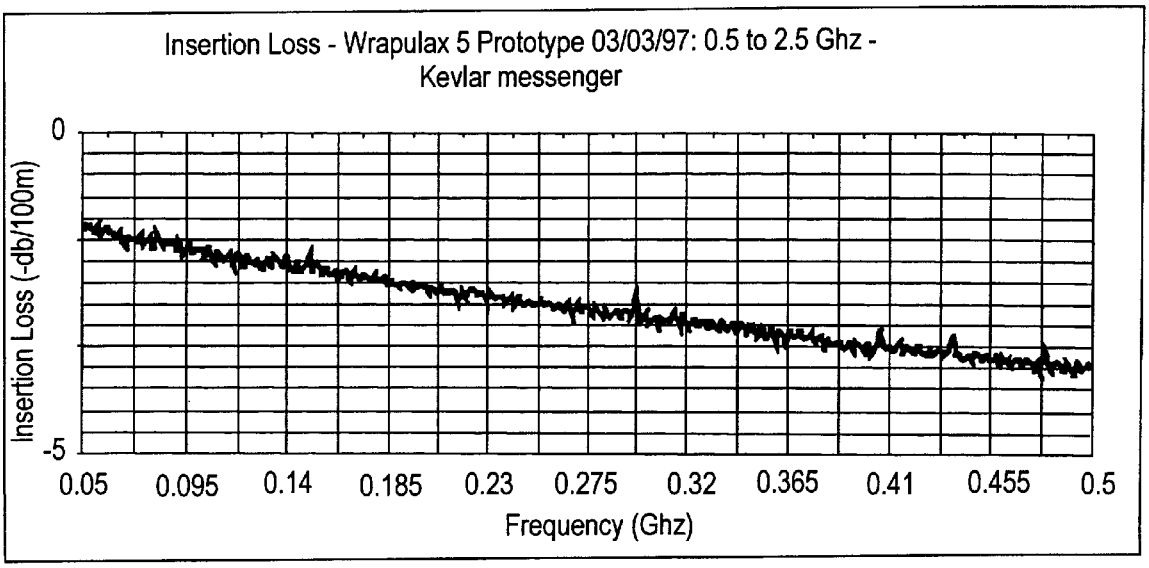

The radiation performance of the radiating cable 10 may be defined in terms of its radiating efficiency, insertion loss and return loss, each having a theoretical value which may be derived using techniques known in the art. The amount of radiation or loss from the cable is a function of the diameter of the center conductor 12, the pattern and dimensions of the apertures 22, the dielectric constant and diameter of the dielectric core 14, and the frequency of operation of the cable 10. With the materials and dimensions discussed above in relation to FIG. 1*a*, experimental data has shown the cable 10 to have a radiating efficiency, defined in terms of coupling loss to a dipole (95% data), as shown in Table 1 below and an insertion loss as shown in FIGS. 1*d* and 1*e*.

TABLE 1

RADIATING EFFICIENCY of ⅞ INCH CABLE.

| FREQUENCY (MHz) | COUPLING (95%) |
|---|---|
| 80 | 63 db |
| FM | 69 |
| 150 | 74 |
| 280 | 77 |
| 450 | 77 |
| 900 | 77 |
| PCS | 74 |
| 2480 | 72 |

Figure 2C:
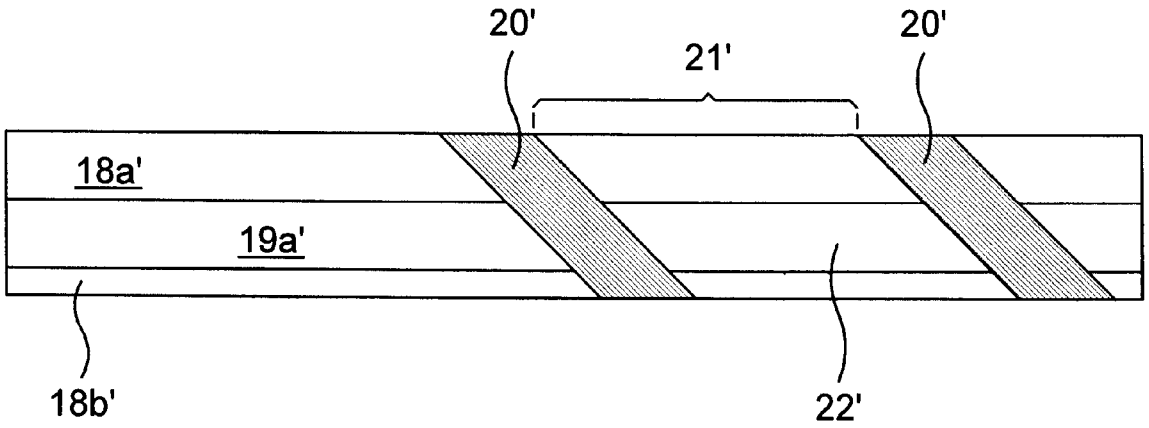
FIG. 2*c* is a side view depicting an intermediate step in constructing the radiating coaxial cable of FIG. 2*a*.
Figure 2B:
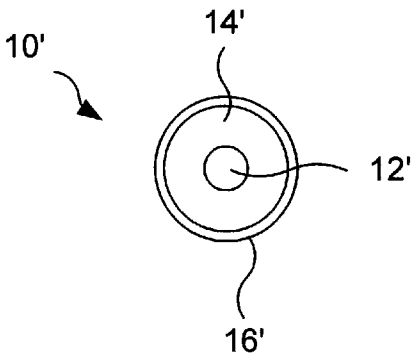
FIG. 2*b* is an end view of the radiating coaxial cable of FIG. 2*a*.
Figure 2A:
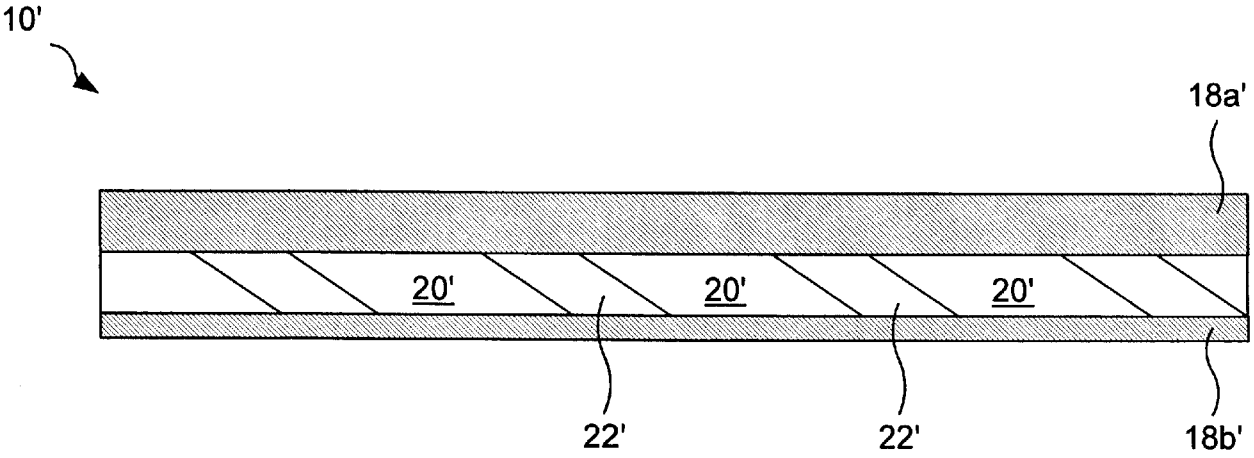
FIG. 2*a* is a side view of a radiating coaxial cable with apertures formed by two conducting strips according to an another embodiment of the present invention.
Figure 3:
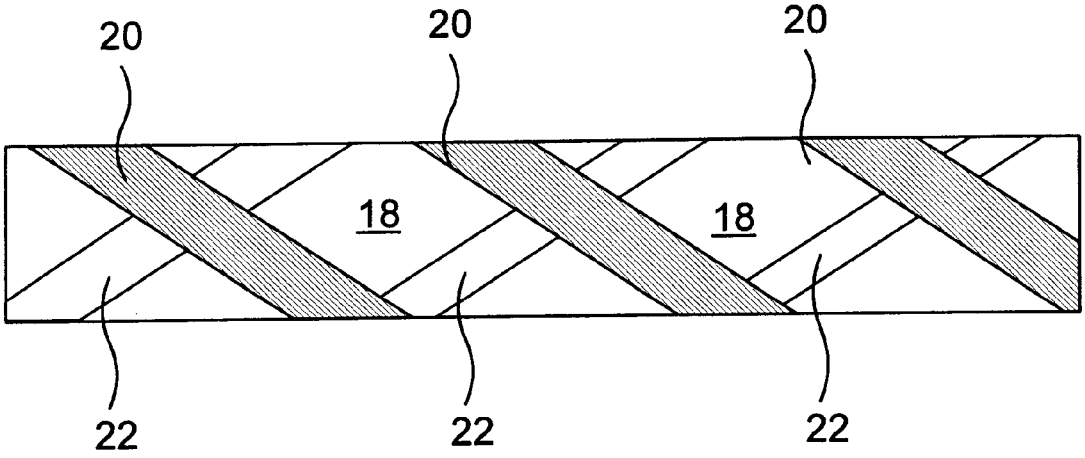
FIG. 3 is a side view of a radiating coaxial cable with apertures formed by two conducting strips according to yet another embodiment of the present invention.

Now referring to FIGS. 2*a* through 2*c*, there is shown an alternative embodiment of radiating coaxial cable, designated by reference numeral 10'. The cable 10' is comprised of a center conductor 12' (FIG. 2*b*) surrounded by a dielectric core 14', and an outer conductor 16' formed by two conductive strips 18'*a,b* and a single conductive strip 20' disposed on an outer surface of the dielectric core 14'. The center conductor 12' and conductive strips 18',20' may consist of virtually any type of conductive material including, for example, copper or aluminum, whereas the dielectric core 14' may consist of virtually any type of dielectric (non-conductive) material. The conductive strips 18'*a,b* and 20' are wrapped about the dielectric 14' in coaxial relationship to the center conductor 12' and define a plurality of gaps or apertures 22' between the conductive strips 18'*a,b* and 20' for radiating and receiving electromagnetic energy in response to excitation of the cable 10'. The width and wrap angle of conductive strips 18'*a,b* and 20' affect the pattern, size and shape of the apertures 22', which in turn affects the radiation characteristics of the cable 10'.

In the embodiment shown in FIGS. 2*a* through 2*c*, the conductive strips 18'*a,b* are laid axially (i.e., at zero degrees relative to the center conductor 12'), and the conductive strip 20' is spirally wrapped about the dielectric 14' to produce generally diamond-shaped apertures 22' along the length of the cable 10'. It will be appreciated that fewer or greater numbers of conductive strips 18'*a,b* or 20' may be employed and that conductive strip (or strips) 20' may be wrapped at virtually any wrap angle sufficient to produce a desired pattern, size and/or shape of apertures 22'. The wrap angle of conductive strip(s) 20' may also be varied along the length of the cable 10' as needed or desired to affect the radiation characteristics of the cable 10'.

In one embodiment, the conductive strips 18'*a,b* each comprise a 1¼-inch wide copper strip and conductive strip 20' comprises a ¼-inch wide copper strip disposed around a ⅞-inch foam dielectric core 14'. Conductive strips 18'*a,b* are axially disposed about the dielectric 14' at an angle of substantially zero degrees relative to the center conductor 12' separated from each other by respective longitudinal gaps 19'*a,b* each having a width of about 0.125 inch (FIG. 2*c*). Next, the conductive strip 20' is spirally wound about portions of the dielectric 14' and portions of the longitudinal gaps 19'*a,b*. Adjacent wraps of conductive strip 20' are separated from each other by a continuous helical gap 21' having a width of about 0.325 inches. Conductive strip 20' physically and electrically contacts portions of the underlying conductive strip 18' such that the first and second conductive strips 18',20' define in combination the outer conductor 16' of the radiating coaxial cable 10'. Conversely, the intersection of gaps 19',21' define the apertures 22' of the radiating coaxial cable 10'. In this embodiment, the apertures 22' have a width of about 0.125 inches (corresponding to the width of the longitudinal gaps 19'*a,b*) and a length of about 0.325 inches (corresponding to the width of helical gap 21'). In one embodiment, the cable 10' is then wrapped with a protective outer cover or "jacket" to protect the cable 10' from elements, abrasions and the like.

The pattern, size and shape of the apertures 22' may be varied by changing the width and/or wrap angle of the conductive strips 18',20' and the width of the helical gaps 19',21'. The apertures 22' may be graded (i.e., made progressively larger (or smaller) along the length of the cable 10') by progressively increasing (or decreasing) the width of either or both gaps 19',21' to compensate for attenuation losses as signals propagate through the cable and allow for an even distribution of energy along the cable.

In either of the above-described embodiments, the cable can be reasonably bent or coiled without the formation of wrinkles associated with cables formed from solid outer conductors. One of the reasons this may be achieved in the present invention is that the conductive strips 18,20 (or 18',20') are not attached to each other, but merely overlap and physically and electrically contact each other to form the outer conductor 16 (or 16'). This feature permits individual wraps of conductive strips 18,20 (or 18',20') to move relative to each other when the cable 10 (or 10') is bent or coiled. The relative movement of conductive strips 18,20 (or 18',20') causes the cable to be rather flexible, and reduces the likelihood that wrinkles will be formed when the cable is bent or coiled.

The radiating cable 10 (or 10') may be quickly and inexpensively manufactured by using wrapping machines known in the art. Generally, wrapping machines may be programmed in advance, or signaled in real-time (e.g., as the product is being made) to vary line speeds, tape wrapping angles and wrapping speeds in order to produce a desired pattern, size and/or shape of apertures 22 (or 22'). The various wrapping parameters may be programmed or signaled to occur in almost any progression (e.g., in a step function, linear function, etc.) along the length of the cable 10 (or 10'). Dual-tape wrapping machines may be employed to simultaneously wrap both conductive strips 18,20 (or 18',20') about the dielectric 14 (or 14'), thus forming outer conductor 16 (or 16') in a single pass. Added features such as fire retardant tapes or jackets may be applied on subsequent machines.

In a wrapping machine, graded cables with progressively larger apertures 22 (or 22') may be achieved by increasing the line speed, reducing the tape wrapping angle and/or reducing the wrapping speed of the wrapping machine. Conversely, progressively smaller apertures 22 (or 22') may be achieved by decreasing the line speed, increasing the tape wrapping angle and/or increasing the wrapping speed of the wrapping machine.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A radiating coaxial cable comprising a center conductor;

a dielectric surrounding the center conductor; and a first and a second solid conductive strip wrapped about the dielectric in coaxial relationship to said center conductor and with a plurality of gaps between said first and second conductive strips, said first and second conductive strips defining in combination an outer conductor of said radiating cable, said plurality of gaps defining a plurality of apertures for radiating and receiving electromagnetic energy.

2. The radiating coaxial cable of claim 1 wherein the first conductive strip is spirally wound about the dielectric to define a plurality of wraps of said first conductive strip separated by a first helical gap, and wherein the second conductive strip is spirally wound about the first conductive strip to define a plurality of wraps of said second conductive strip separated by a second helical gap, the wraps of said first and second conductive strips defining in combination the outer conductor of said radiating coaxial cable, the first and second helical gaps intersecting to define the plurality of apertures of said radiating coaxial cable.

3. The radiating coaxial cable of claim 2 wherein each of said first and second helical gaps has a substantially constant width along the length of said cable.

4. The radiating coaxial cable of claim 3 wherein the width of said first helical gap is about 0.1 inch and wherein the width of said second helical gap is about 0.66 inch, the intersection of said first and second helical gaps defining a plurality of apertures having dimensions of about 0.66 inch by 0.1 inch.

5. The radiating coaxial cable of claim 2 wherein at least one of said first and second helical gaps has a progressively increasing width along the length of said cable to progressively increase the size of said apertures along the length of said cable.

6. A radiating coaxial cable comprising a center conductor;

a dielectric surrounding the center conductor; and a first and a second conductive strip wrapped about the dielectric in coaxial relationship to said center conductor and with a plurality of gaps between said first and second conductive strips, the first and second conductive strips having generally different widths, the first conductive strip being spirally wound about the dielectric to define a plurality of wraps of said first conductive strip separated by a first helical gap, the second conductive strip being spirally wound about the first conductive strip to define a plurality of wraps of said second conductive strip separated by a second helical gap, each of the first and second helical gaps having a substantially constant width along the length of said cable, the first helical gap having a width of about 0.1 inch and the second helical gap having a width of about 0.66 inch, the wraps of said first and second conductive strips defining in combination an outer conductor of said radiating cable, the first and second helical gaps intersecting to define a plurality of apertures having dimensions of about 0.66 inch by 0.1 inch for radiating and receiving electromagnetic energy.

7. The radiating coaxial cable of claim 6 wherein the first conductive strip has a width of about one inch and the second conductive strip has a width of about one-quarter inch.

8. A radiating coaxial cable comprising a center conductor;

a dielectric surrounding the center conductor; and a plurality of conductive strips wrapped about the dielectric in coaxial relationship to said center conductor and defining in combination an outer conductor of said radiating cable, a first number of said conductive strips being disposed at an angle of about zero degrees relative to said center conductor and defining one or more longitudinal gaps along a length of said cable, a second number of said conductive strips being wrapped at an angle substantially greater than zero degrees relative to said center conductor and defining one or more helical gaps along the length of said cable, an intersection of said one or more longitudinal gaps and said one or more helical gaps defining a plurality of apertures for radiating and receiving electromagnetic energy.

9. The radiating coaxial cable of claim 8 wherein said first number of conductive strips comprise two longitudinal conductive strips and wherein said one or more longitudinal gaps comprise two longitudinal gaps.

10. The radiating coaxial cable of claim 8 wherein the second number of conductive strips comprises one spiral conductive strip and wherein said one or more helical gaps comprise one helical gap, the intersection of said longitudinal gaps and said helical gap defining said plurality of apertures of said cable.

11. The radiating coaxial cable of claim 10 wherein said helical gap has a substantially constant width along the length of said cable.

12. The radiating coaxial cable of claim 10 wherein the width of each of said longitudinal gaps is about 0.125 inch and wherein the width of said helical gap is about 0.325 inch, the intersection of said longitudinal and helical gaps defining a plurality of apertures having dimensions of about 0.125 inch by 0.325 inch.

13. The radiating coaxial cable of claim 10 wherein at least one of said longitudinal and helical gaps has a progressively increasing width along the length of said cable to progressively increase the size of said apertures along the length of said cable.

14. The radiating coaxial cable of claim 12 wherein the longitudinal conductive strips each have a width of about 1¼ inch and wherein the spiral conductive strip has a width of about one-quarter inch.

15. A method of making a radiating coaxial cable comprising the steps of:

encircling a center conductor with a dielectric; and wrapping a first and a second solid conductive strip about the dielectric in coaxial relationship to said center conductor and forming a plurality of gaps between said first and second conductive strips, said first and second conductive strips defining in combination an outer conductor of said radiating cable, said plurality of gaps defining a plurality of apertures for radiating and receiving electromagnetic energy.

16. The method of claim 15 wherein the step of wrapping a first and second conductive strip about the dielectric comprises the steps of:

spirally winding the first conductive strip about the dielectric to define a plurality of wraps of said first conductive strip separated by a first helical gap; and spirally winding the second conductive strip about portions of the dielectric and portions of the first conductive strip to define a plurality of wraps of said second conductive strip separated by a second helical gap, the wraps of said first and second conductive strips defining in combination the outer conductor of said radiating coaxial cable, the first and second helical gaps intersecting to define the plurality of apertures of said radiating coaxial cable.

17. A method of making a radiating coaxial cable comprising the steps of:

encircling a center conductor with a dielectric;

wrapping a first number of conductive strips about the dielectric at an angle of about zero degrees relative to said center conductor and defining one or more longitudinal gaps along a length of said cable; and wrapping a second number of conductive strips about portions of the dielectric and portions of the first number of conductive strips at an angle greater than zero degrees relative to said center conductor and defining one or more helical gaps along the length of said cable, the combination of said first number of conductive strips and said second number of conductive strips defining an outer conductor of said cable, the intersection of said one or more longitudinal gaps and said one or more helical gaps defining a plurality of apertures for radiating and receiving electromagnetic energy.

* * * * *